United States Patent [19]

Krasnoff

[11] 4,425,835

[45] Jan. 17, 1984

[54] FLUID ACTUATOR

[75] Inventor: Eugene L. Krasnoff, Princeton, N.J.

[73] Assignee: Ingersoll-Rand Company, Woodcliff Lake, N.J.

[21] Appl. No.: 228,383

[22] Filed: Jan. 26, 1981

[51] Int. Cl.[3] ..... F01L 25/02; F01B 7/18

[52] U.S. Cl. ..... 91/317; 91/285; 91/321

[58] Field of Search ..... 91/317, 299, 284, 285, 91/289, 321

[56] References Cited

U.S. PATENT DOCUMENTS

| | | | |
|---|---|---|---|
| 2,609,791 | 9/1952 | Bohlman | 91/317 |
| 2,970,579 | 2/1961 | Paris | 91/317 |
| 3,786,723 | 1/1974 | Fruehauf | 91/284 |

FOREIGN PATENT DOCUMENTS

| | | | |
|---|---|---|---|
| 383751 | 10/1923 | Fed. Rep. of Germany | 91/317 |
| 1240116 | 7/1960 | France | 91/285 |
| 784684 | 10/1957 | United Kingdom | 91/317 |

*Primary Examiner*—Paul E. Maslousky
*Attorney, Agent, or Firm*—Walter C. Vliet

[57] ABSTRACT

This invention pertains to a fluid actuator having piston chambers, a piston maintained within said chambers, a valve means for reciprocating the piston and a pressure control means for varying the force to the valve means wherein the reciprocating frequency of the piston is modulated.

6 Claims, 5 Drawing Figures

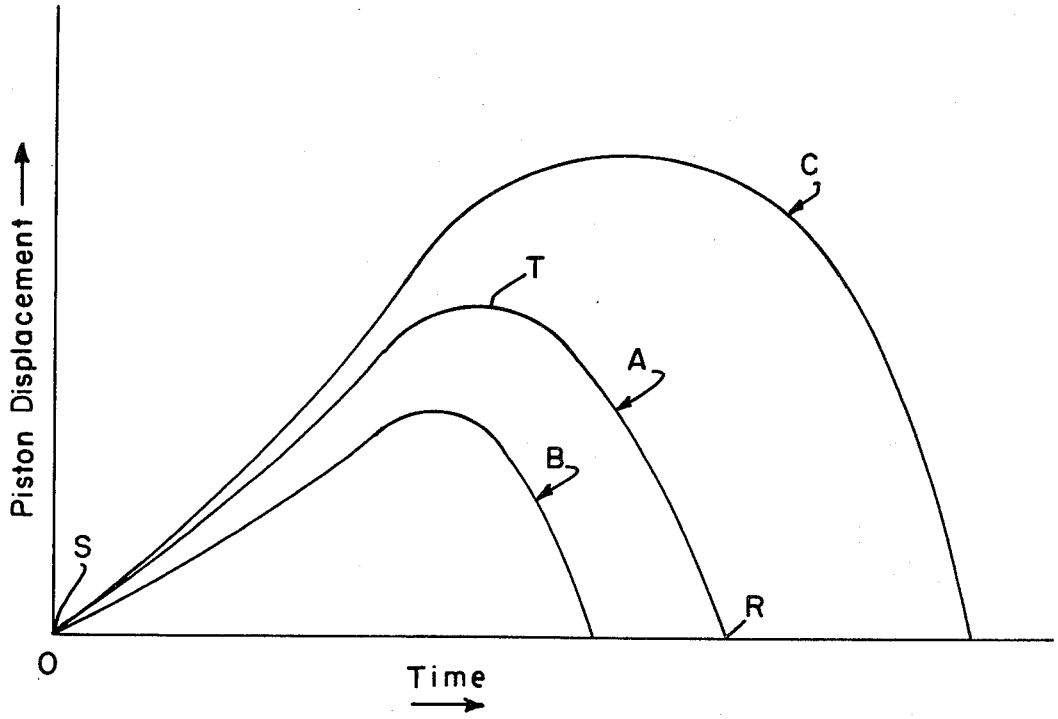
FIG. 3
FIG. 4
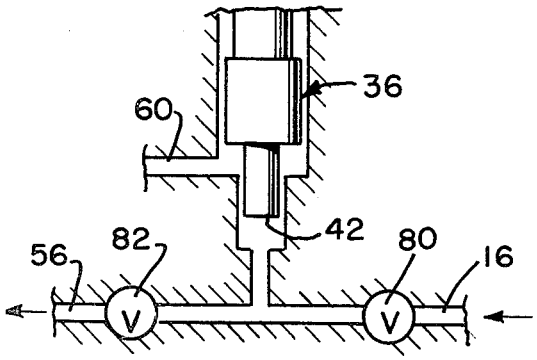
FIG. 5
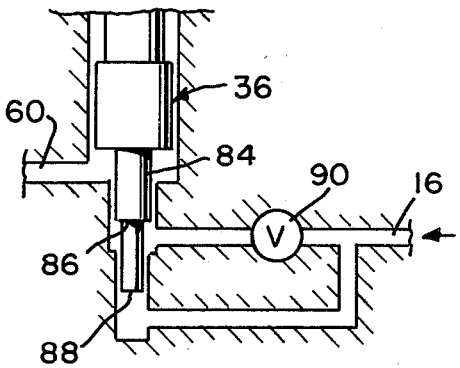

FLUID ACTUATOR

BACKGROUND OF THE INVENTION

1. Field of the Invention

This invention pertains to a fluid actuator and more particularly to a hydraulic actuator having a piston and a valve means wherein a force applied to the valve means is varied resulting in a frequency change of piston reciprocation.

2. Description of the Prior Art

In U.S. Pat. No. 4,143,447 to Krasnoff et al. and U.S. Pat. No. 4,192,219 to Krasnoff et al., a hydraulically operated reciprocating piston is described wherein the piston in cooperation with a cushion chamber, a liquid supply source and a valve means reciprocate the piston.

These apparatuses are useful in hydraulic rock drilling operations. Drilling hard rock calls for high energy blow at any given power level. This is especially important when drilling deep holes. Soft rock requires a lower blow energy and force level for optimum penetration at a given power level. In the above mentioned patents, in order to change the blow energy and frequency of reciprocation of the piston it is necessary to change the design of the apparatus. A single rock drill actuator of small size and high efficiency for both hard and soft rock is desirable.

SUMMARY OF THE INVENTION

This invention relates to a fluid actuator having a housing and a fluid supply source for supplying pressurized fluid to the fluid actuator. A piston chamber is also provided within the housing. A piston mounted within the piston chamber is provided. First means for moving the piston in a first direction, second means for moving the piston in a second direction, and means for producing an increasing and decreasing fluid pressure source is also provided. A valve means communicates with the liquid supply source and the increasing and decreasing pressure source producing a first and second force on the valve means. The valve means actuates the first and second piston means when the valve is in a first and second position respectively. A means for varying at least one of the valve forces is provided which controls the frequency of reciprocation of the piston.

BRIEF DESCRIPTION OF THE DRAWINGS

FIG. 3 is a graph plotting piston displacement versus time.

FIG. 4 is a schematic illustration showing a means for modifying the force applied to the valve.

FIG. 5 is a schematic illustration showing a means for modifying the force applied to the valve.

DESCRIPTION OF THE PREFERRED EMBODIMENTS

Figure 1:
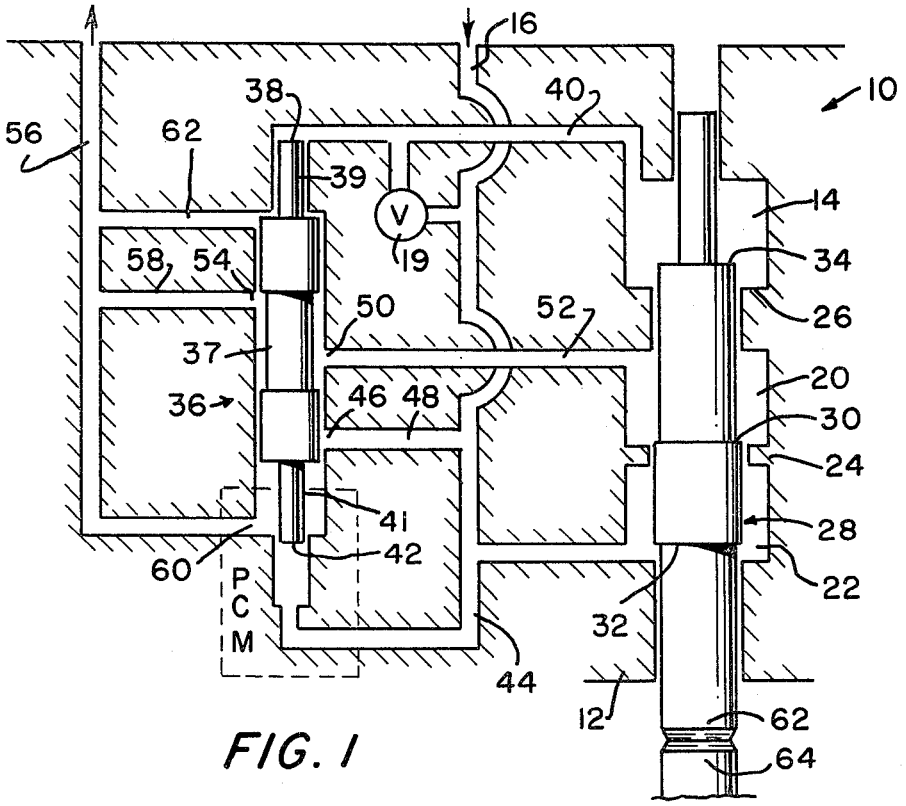
FIG. 1 is a schematic illustration of a fluid actuator showing one position of the piston and the valve.

Referring to FIG. 1 a fluid actuator is shown. Fluid actuator 10 comprises a housing 12. Housing 12 may be a single casting, segments bolted or welded together by conventional means or several segments interconnected with conventional means such as tubing. Within housing 12 is a cushion chamber 14. Fluid source 16 supplies pressurized fluid to fluid actuator 10 which provides the energy source for reciprocating fluid piston 28. Fluid source includes conventional sources such as hydraulic and pneumatic supply sources. Cushion chamber 14 is filled with fluid by means of valve 19. Valve 19 includes conventional valves such as pressure check valves. Within housing 12 is a piston chamber 18 which comprises a first piston chamber 20 and a second piston chamber 22. A bore 24 formed in the housing 12 separates the first piston chamber 20 from the second piston chamber 22. A bore 26 also formed in the housing 12 interconnects the cushion chamber 14 with first piston chamber 20. Within piston chamber 18 is located a piston 28. Piston 28 extends into cushion chamber 13. Piston 28 comprises a first pressure surface 30 located within first piston chamber 20 and a second pressure surface 32 located within second piston chamber 22. Piston 28 also comprises cushion chamber pressure surface 34 located within cushion chamber 14.

Figure 2:
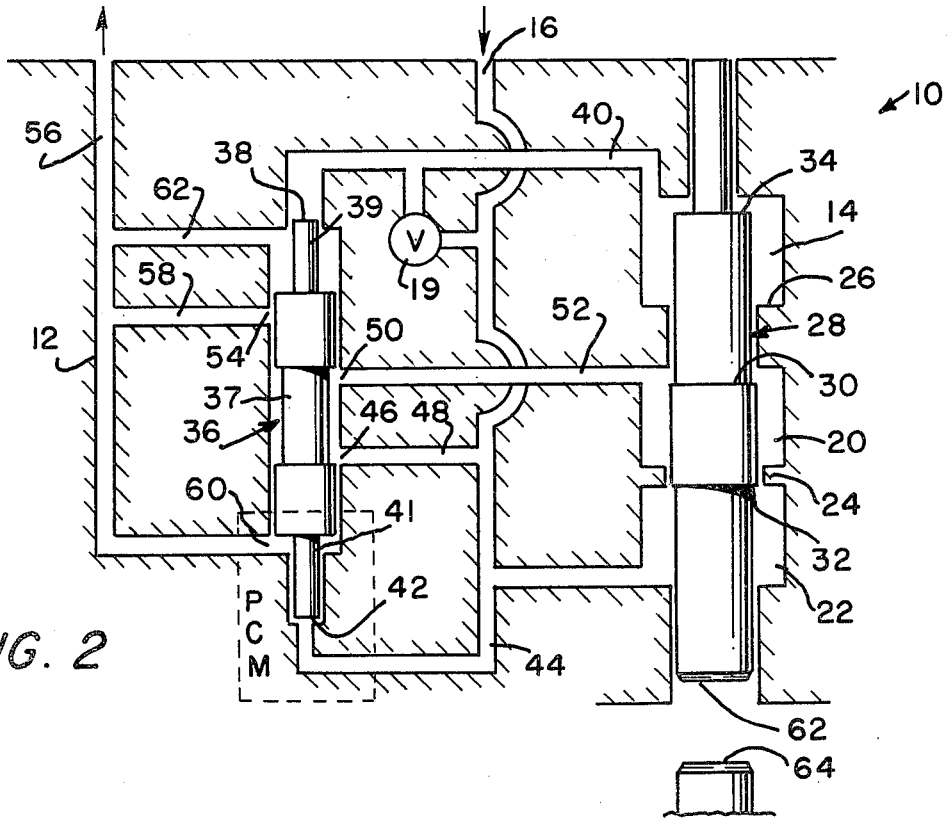
FIG. 2 is a schematic illustration of a fluid actuator showing the piston and valve in another position.

A valve 36 is provided for reciprocating piston 28. Valve 36 may be comprised of one piece or be comprised of a body 37 with one or more pins in contact with body 37 such as pins 39 and 41, shown in FIGS. 1 and 2. Valve 36 has a first valve surface 38 for communicating with cushion chamber 14 by means of passage 40. Valve 36 also has a second valve surface 42 for communicating with pressure source 16 through passage 44. Valve 36 has a first port 46 which communicates with fluid source 16 through passage 48 and a second port 50 which communicates with first piston chamber 20 by means of passage 52. Valve 36 also contains a third port 54 which communicates with a fluid exhaust means 56 by means of passage 58. Ports 60 and 62 also communicate with fluid exhaust means 56. As shown in FIG. 1 piston 28 is shown in a first position and valve 36 is shown in a first position. Fluid from fluid source 16 enters second piston chamber 22 and exerts pressure on surface 32. Valve 36 shown in the first position in FIG. 1 permits port 50 to communicate with port 54 wherein liquid from first piston chamber 20 communicates with exhaust means 56. This forces piston 28 to move in a first direction towards a second piston position as shown in FIG. 2. As piston 28 moves in a first direction surface 34 compresses the fluid in cushion chamber 14. The pressure in cushion chamber 14 times surface area 38 produces a first force on valve 36 tending to move valve 36 from the first position to a second position as shown in FIG. 2. This movement is opposed by a second force resulting from the pressure of liquid source 16 times surface area 42. As piston 28 moves to the second position the pressure in cushion chamber 14 increases and the first force on valve 36 exceeds the second force wherein valve 38 moves to the second position. When valve 36 is in the second position port 46 communicates with port 50. Thus first piston chamber 20 communicates with liquid source 16 rather than communicating with exhaust means 56. The pressure in first pressure chamber 20 is thus increased. The increased pressure in first piston chamber 20 acting on surface 30 in conjunction with the cushion chamber pressure acting on surface 34 overcomes the force produced by the pressure in second pressure chamber 22 acting on surface 32. Piston 28 then moves in a second direction to the first position as shown in FIG. 1. Piston 28 has a striking surface 62 which strikes a surface 64 which surface includes drill steel surfaces. As piston 28 moves to the first position, the pressure in chamber 14 decreases. As the pressure in chamber 14 decreases, supply pressure 16 times area 42 is greater than cushion chamber pressure 14 times 38. Valve 36 then moves to position 1 as shown in FIG. 1. The pressure in first piston chamber 20 decreases since chamber 20 communicates with exhaust means 56 rather than source 16. The cycle is completed and begins to repeat itself.

According to the present invention at least one of the valve forces is pressurized by a selected portion of the supplied fluid pressure. This changes the operating characteristics of the cycle and hence the frequency of reciprocation.

FIG. 3 is a plot of piston displacement verses time. Point S of curve A is the position of piston 28 at the first position as shown in FIG. 1. Point T is the position of 28 at the second position as shown in FIG. 2. Point R is the position of Piston 28 returned to the first position as shown in FIG. 1, thus completing the cycle. In one embodiment of this invention the second force on surface 42 is reduced, the cycle time and piston displacement is decreased as shown by curve B. If the second force is varied with an increased force, the cycle time and piston displacement will be increased as shown by curve C. Force control means for varying the second force applied to valve 36 include conventional means as shown in FIGS. 4 and 5.

In FIG. 4, valves 80 and 82 control the pressure on 42. As valve 82 is opened and valve 80 is closed, the pressure on surface 42 decreases and the period of piston 28 decreases. As valve 82 is closed and valve 80 is opened, the pressure on surface 42 increases causing the period of piston 28 to increase.

In FIG. 5 a pin 84 is shown which has a surface 86 and a surface 88. A valve 90 is also provided. When valve 90 is open, the second force on piston 36 is supply pressure 16 times area 86 plus area 88. When valve 90 is closed, the second force on valve 36 is supply pressure 16 times area 88 only and accordingly the period of piston 28 is decreased. This embodiment provides for an incremental change in piston frequency where as the embodiment shown in FIG. 5 provides for a continuous change in frequencies. Similar devices may be employed to bias the first force applied to valve 36.

I claim:

1. An actuator comprising:

(a) a housing;

(b) a fluid source for supplying pressurized fluid to the actuator;

(c) a piston chamber within the housing;

(d) a piston disposed within the piston chamber said piston having:

i. a first piston means for moving the piston in a first piston direction;

ii. a second piston means for moving the piston in a second piston direction; and iii. a third means for producing an increasing and decreasing fluid pressure source as the piston reciprocates;

(e) a valve means for actuating the first and second piston means to reciprocate the piston wherein said valve means communicates with the fluid source producing a first force on the valve means and said valve means communicates with the increasing and decreasing pressure source causing an increasing and decreasing second force on the valve means; and (f) a pressure control means for varying the fluid source pressure acting on the valve means wherein the piston reciprocating frequency is modified.

2. An actuator according to claim 1 wherein the pressure control means comprises a pressure regulating valve means.

3. A hydraulic actuator comprising:

(a) a housing;

(b) a liquid source for supplying pressurized liquid to the hydraulic actuator;

(c) a liquid filled cushion chamber within the housing;

(d) a piston chamber within the housing;

(e) a bore interconnecting the cushion chamber and the piston chamber;

(f) a piston disposed within the piston chamber and extending into the cushion chamber said piston having a first means for moving the piston in a first direction, a second means for moving the piston in a second direction and a third means for increasing and decreasing the pressure in the cushion chamber;

(g) a valve means for actuating the first means when the valve means is in a first position and for actuating the second means when the valve means is in a second position wherein said valve communicates with the cushion chamber and the liquid source which reciprocates the valve means between position one and position two; and (h) a pressure control means for varying the pressure of the liquid source communicating with the valve means.

4. A hydraulic actuator according to claim 3 wherein the pressure control means comprises a pressure regulating valve means.

5. A hydraulic actuator comprising:

(a) a housing;

(b) a liquid source for supplying pressurized liquid to the hydraulic actuator;

(c) a liquid filled cushion chamber within the housing;

(d) a piston chamber within the housing, said piston chamber having a first piston chamber and a second piston chamber, a portion of said housing separating the first piston chamber from the second piston chamber, wherein the second piston chamber communicates with the liquid source;

(e) a bore interconnecting the cushion chamber and the first piston chamber;

(f) a piston disposed within the piston chamber;

i. said piston extending through the interconnecting bore and into the cushion chamber;

ii. said piston having a first pressure surface in the first piston chamber and a second pressure surface in the second piston chamber;

iii. said piston also having a cushion chamber pressure surface in the cushion chamber which increases the pressure in the cushion chamber during movement in a first direction and decreases the pressure in the cushion chamber during movement in a second direction;

(g) a valve for reciprocating the piston comprising:

i. a first valve surface communicating with the cushion chamber producing a force tending to move the valve towards a second position;

ii. a second valve surface communicating with the liquid source producing a force tending to move the valve towards a first position;

iii. a first port communicating with the liquid source;

iv. a second port communicating with the first piston chamber;

v. a third port for exhausting operating liquid from the valve means wherein the valve in the second position permits the first port and the second port to communicate moving the piston in the second direction and wherein the valve means in the first position permits the second port and the third port to communicate moving the piston in the first direction; and (h) a pressure control means for varying pressure of the liquid source and thereby the force tending to move the valve towards the first position.

6. A hydraulic actuator according to claim 5 wherein the pressure control means comprises a pressure regulating valve.

* * * * *